US008256144B2

(12) United States Patent
Comoli

(10) Patent No.: US 8,256,144 B2
(45) Date of Patent: Sep. 4, 2012

(54) SOLE FOR FOOTWEAR HAVING A TURNABLE ANTISLIP DEVICE AND FOOTWEAR COMPRISING SUCH SOLE

(75) Inventor: Francesco Comoli, Biella (IT)

(73) Assignee: ING. Comoli S.R.L., Biella (IT)

( * ) Notice: Subject to any disclaimer, the term of this patent is extended or adjusted under 35 U.S.C. 154(b) by 442 days.

(21) Appl. No.: 12/579,138

(22) Filed: Oct. 14, 2009

(65) Prior Publication Data

US 2010/0088929 A1 Apr. 15, 2010

(30) Foreign Application Priority Data

Oct. 14, 2008 (IT) ..... TO2008A0752

(51) Int. Cl.
*A43B 23/28* (2006.01)

(52) U.S. Cl. ..... 36/59 R; 36/61; 36/100

(58) Field of Classification Search ..... 36/15, 100, 36/59 R, 61, 62
See application file for complete search history.

(56) References Cited

U.S. PATENT DOCUMENTS

| | | | | | |
|---|---|---|---|---|---|
| 192,057 | A | * | 6/1877 | Dewey | 36/61 |
| 286,240 | A | * | 10/1883 | Treat | 36/61 |
| 997,055 | A | | 7/1911 | Gilowitz | |
| 1,034,997 | A | * | 8/1912 | Gibson | 36/61 |
| 1,047,716 | A | * | 12/1912 | Sperling | 36/61 |
| 1,160,425 | A | * | 11/1915 | Malmstrom | 36/61 |
| 1,215,539 | A | * | 2/1917 | Ischer | 36/61 |
| 1,259,705 | A | * | 3/1918 | Ajello | 36/61 |
| 2,065,386 | A | * | 12/1936 | Mattsson | 36/61 |
| 2,331,609 | A | * | 10/1943 | Harvey | 36/61 |
| 2,776,499 | A | * | 1/1957 | Giuntini | 36/135 |
| 2,968,878 | A | * | 1/1961 | James | 36/61 |
| 4,745,692 | A | | 5/1988 | Liao | |
| 6,360,455 | B1 | * | 3/2002 | Seo | 36/61 |
| 6,385,865 | B1 | * | 5/2002 | Jang et al. | 36/61 |
| 7,269,916 | B2 | * | 9/2007 | Biancucci et al. | 36/61 |
| 7,836,610 | B2 | * | 11/2010 | Laporte | 36/62 |
| 2004/0035024 | A1 | * | 2/2004 | Kao | 36/61 |
| 2008/0010858 | A1 | * | 1/2008 | Yen | 36/61 |

FOREIGN PATENT DOCUMENTS

| | | | |
|---|---|---|---|
| DE | 877 870 | C | 5/1953 |
| FR | 2 076 475 | A5 | 10/1971 |
| WO | WO 2004/041016 | A1 | 5/2004 |

* cited by examiner

*Primary Examiner* — Marie Patterson
(74) *Attorney, Agent, or Firm* — Merchant & Gould P.C.

(57) ABSTRACT

A sole and footwear including such a sole is provided with at least one turnable antislip device provided on the tread surface operatively facing towards the ground. The antislip device includes an articulation structure mounted on the tread surface and oscillatable moving away from the tread surface with respect to an oscillation axis; a support element having an antislip side, accommodated in an associated accommodation portion provided for on the tread surface, and rotatingly mounted with respect to the articulation structure around a revolution axis different from the oscillation axis, directing the antislip side selectively in an activated state towards the ground or in an inactivated state towards the tread surface. The rotation of the support element around the revolution axis controls the rotation of the articulation structure with respect to the oscillation axis.

11 Claims, 6 Drawing Sheets

SOLE FOR FOOTWEAR HAVING A TURNABLE ANTISLIP DEVICE AND FOOTWEAR COMPRISING SUCH SOLE

This application claims benefit of Serial No. TO2008T000752, filed Oct. 14, 2008 in Italy and which application is incorporated herein by reference. To the extent appropriate, a claim of priority is made to the above disclosed application.

BACKGROUND OF THE INVENTION

The present invention refers to a sole for footwear having a turnable antislip device and footwear comprising such sole.

More specifically, the present invention refers to a sole for footwear according to the preamble of the attached claim 1. An example of this type of sole for footwear is disclosed in EP 1 558 103 and reveals some drawbacks. One drawback is that activation and inactivation of the antislip device requires various manual opening and closing operations to be performed by the user. Initially, one is required to perform an opening movement, rotating the articulation structure with respect to the transverse oscillation axis moving away from the tread surface. Subsequently, maintaining the articulation structure at a position away from the tread surface, one is required to rotate the support element around the revolution axis. Lastly, one is required to move the articulation structure back to the initial position, nearing it and coupling it to the tread surface again.

This drawback particularly arises due to the fact that these manual operations are generally performed by a user wearing winter gloves, a factor limiting his freedom of action to efficiently actuate the device.

SUMMARY OF THE INVENTION

An object of the present invention is that of providing a sole for footwear capable of overcoming this and other drawbacks of the prior art, and which can simultaneously be produced in a simple and inexpensive manner.

BRIEF DESCRIPTION OF THE DRAWINGS

Further characteristics and advantages of the present invention shall be clear from the detailed description that follows, strictly provided for illustrative and non-limiting purposes, with reference to the attached drawings, wherein.

DETAILED DESCRIPTION OF THE PREFERRED EMBODIMENTS

Figure 1:
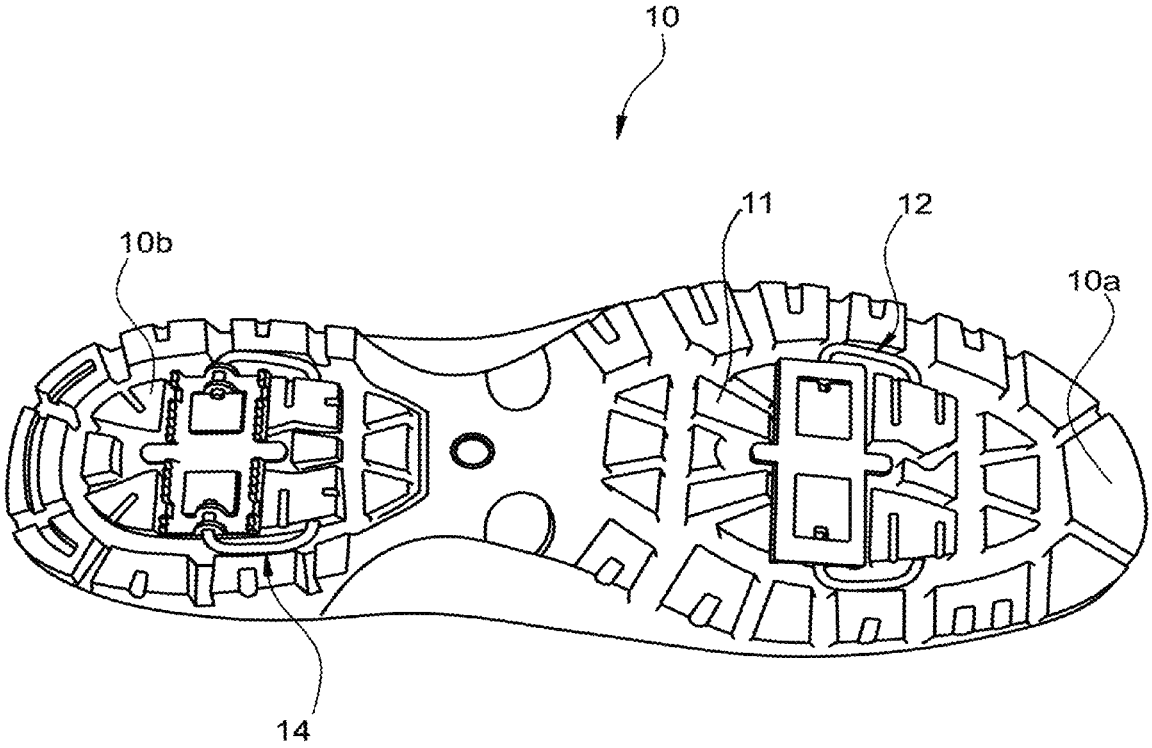
FIG. 1 is a bottom plan view of a sole according to an illustrative embodiment of the present invention.

With particular reference to FIG. 1, an embodiment of a sole for footwear according to the present invention is designated at 10.

The sole 10 has a tread surface 11 operatively facing the ground and provided with a first antislip device 12. Preferably, the tread surface 11 further comprises a second antislip device 14. Advantageously, the first antislip device 12 is located in a front portion of the sole 10, more particularly in the metatarsal zone, where most of the body's weight is concentrated. The second antislip device 14 is located in a rear portion of the sole 10 in proximity to the heel 10*b*.

The antislip devices 12, 14 are substantially identical in terms of structure. Some strictly dimensional variations are basically due to the adjustments required for the application of such devices in the different regions of the sole 10. Therefore, in the present description hereinafter reference shall be made solely to the first antislip device 12, bearing in mind that the same technical characteristics appear in an identical manner in the rear antislip device 14.

With particular reference to FIGS. 2 to 5, the antislip device 12 comprises a support element and an articulation structure. Preferably, the support element comprises a plate 16. Also preferably, the articulation structure comprises a pair of curved rods 18.

Figure 2:
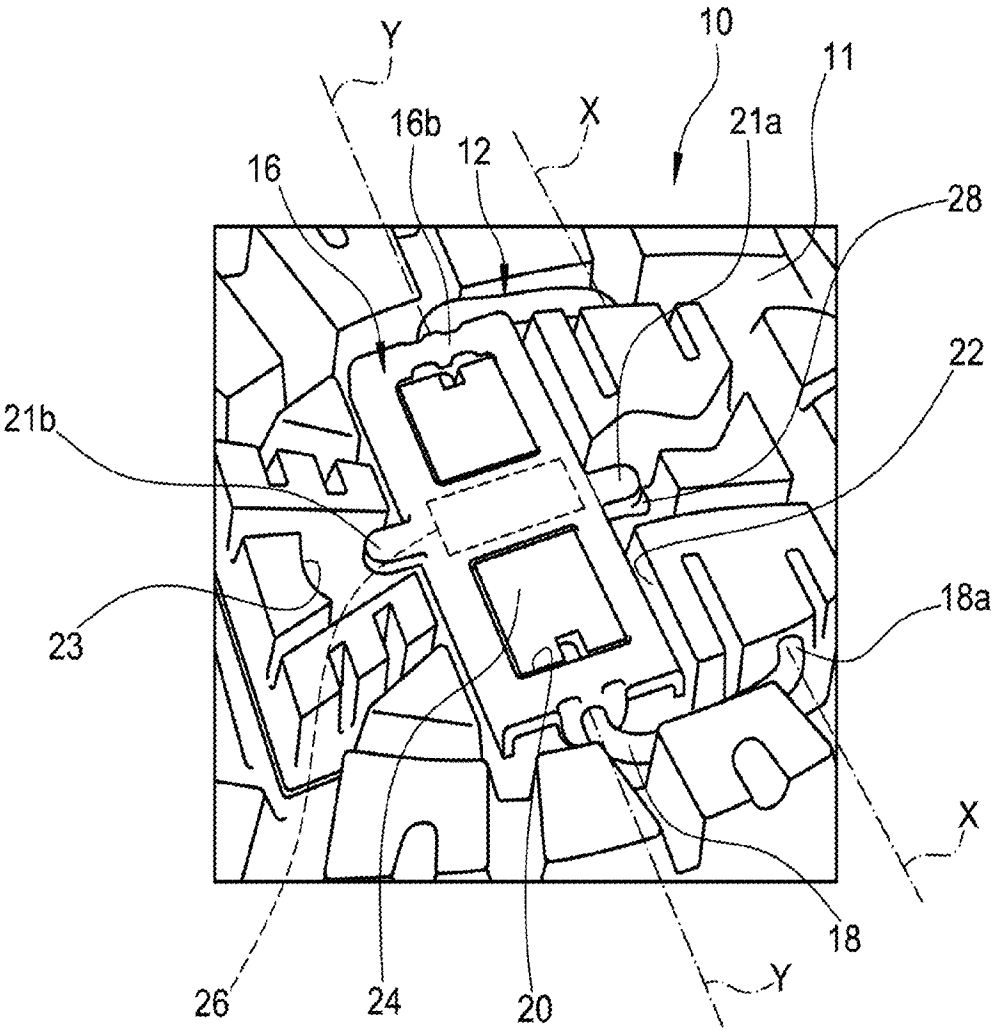
FIG. 2 is an enlarged view of a region of the sole of FIG. 1 shown in a first operative state.

The plate 16 has a first antislip side 16*a* (FIG. 5) which allows increasing friction (also defined as "grip") exerted between the tread surface 11 and the ground when the user wearing the footwear including the sole 10 is walking. Preferably, the antislip side 16*a* is provided with a plurality of antislip elements, for example studs 19 (possibly spikes, or the like). Furthermore, the plate 16 has a second side 16*b* opposite to the first side 16*a* and without the antislip elements (FIG. 2).

Preferably, the plate 16 is rectangular-shaped, it is made of ferromagnetic material and has a pair of shaped windows 20. In the embodiment shown, the studs 19 are advantageously obtained on the opposite longitudinal edges of the first side 16*a*.

The plate 16 may be accommodated in an associated accommodation portion, for example furrows 22 obtained in the tread surface 11. The furrows 22 define a shape complementary to that of the associated plate 16. Preferably, the tread surface 11 further has a pair of shaped projections 24 having a shape complementary to the shaped windows 20. The coupling between the windows 20 and the projections 24 has the advantage of making the accommodation of the plate 16 in the furrows 22 more stable.

Advantageously, the plate 16 has a first countering portion transversely external with respect to the revolution axis Y-Y. In a further preferred manner, the plate 16 also has a second countering portion symmetric to the first countering portion with respect to the revolution axis Y-Y. Conveniently the first and/or second countering portion is a first and/or second projection 21*a*/21*b* projecting transversely with respect to the revolution axis Y-Y. With reference to FIGS. 1 and 2, advantageously, obtained beneath the second projection 21*a* in the tread surface 11 of the sole 10 is a recess 23.

The function of the first and second projection 21*a* and 21*b* shall be outlined hereinafter in the present description.

The pair of curved rods 18 is mounted on the tread surface 11 in an oscillatable manner moving away therefrom with respect to an oscillation axis X-X. As observable in the figures, the oscillation axis X-X is preferably oriented in transverse direction with respect to the sole 10, however, the possibility of obtaining the oscillation axis oriented in longitudinal direction with respect to the sole 10 cannot be excluded.

Also the curved rods 18 may be accommodated in the accommodation portion, defined in this embodiment by the furrows 22. Preferably the curved rods 18 are hinged at the respective proximal ends 18*a*. The plate 16, in turn, is mounted rotating with respect to the distal ends 18*b* of the curved rods 18 around a revolution axis Y-Y. Preferably the revolution axis Y-Y is different from the oscillation axis X-X. Further preferably, the revolution axis Y-Y is substantially parallel to the oscillation axis X-X. Advantageously, with reference in particular to FIGS. 1 and 2, the oscillation axis X-X is located between the tip 10*a* of the sole 10 and the plate 16, when the latter and the curved rods 18 are accommodated in the associated furrows 22.

Figure 5:
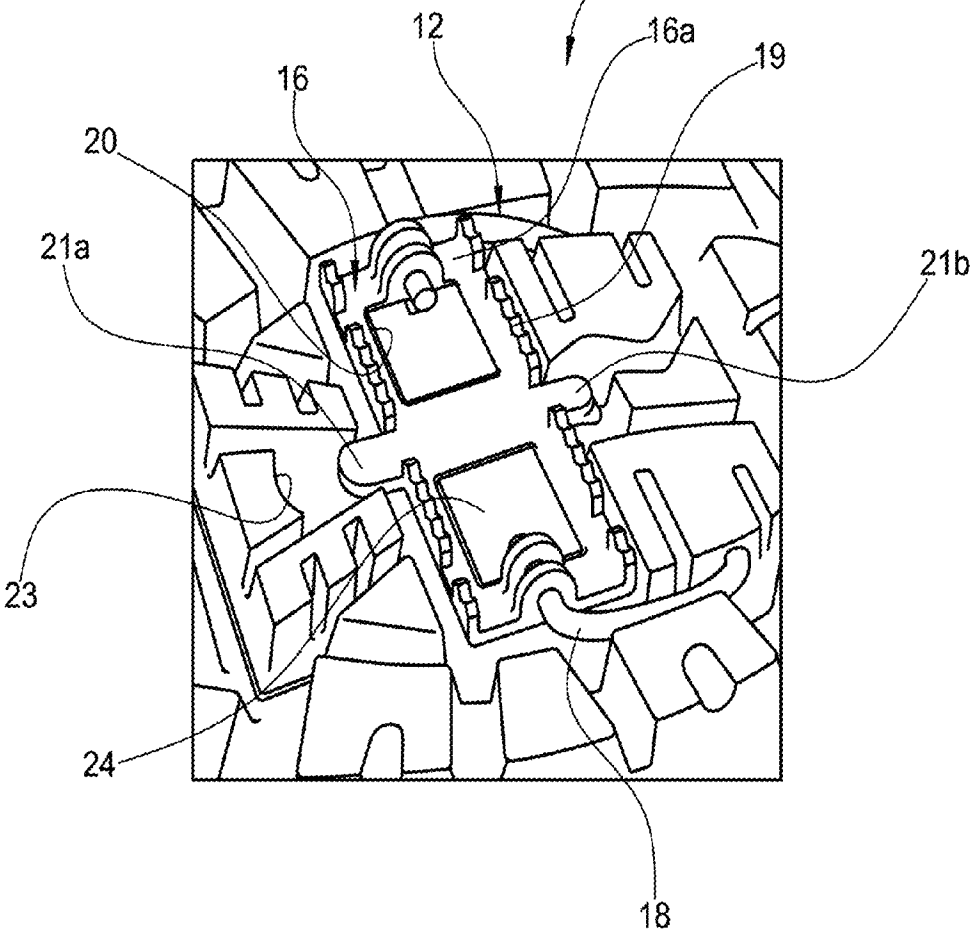
FIG. 5 is a view similar to FIGS. 2 to 4 but showing the sole in a fourth operative state.

In this manner, the plate 16 rotates around the revolution axis Y-Y in two different operative states. In the first "inactivated" operative state it selectively has the antislip side 16*a* facing the tread surface 11 (FIG. 2). In the second "activated" operative state it selectively has the antislip side 16*a* facing the ground (FIG. 5).

Figure 6:
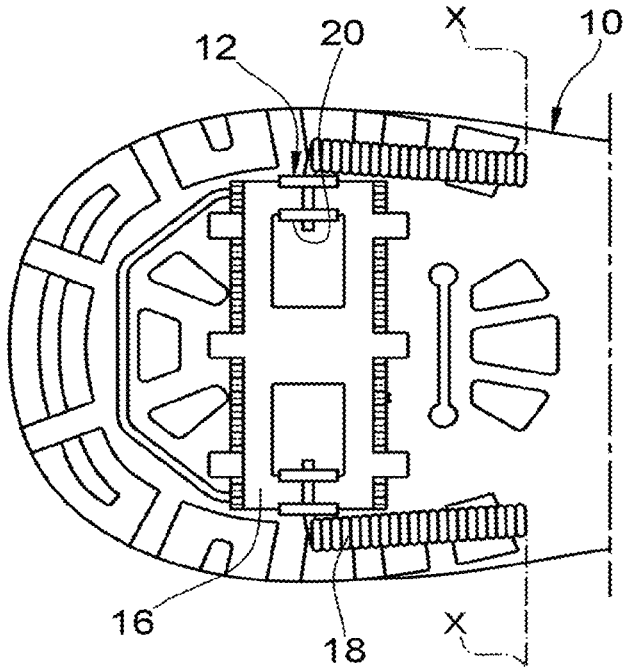
FIG. 6 is a view regarding a possible alternative embodiment of the sole illustrated in the previous figures.

Furthermore, the sole 10 preferably comprises a return element adapted to counter the oscillation obtained by the antislip device 12 with respect to the oscillation axis X-X and oriented moving away with respect to the tread surface 11. In other words, the return element tends to withhold the plate 16 and the curved rods 18 within the furrows 22. Advantageously the return element comprises a magnet 26 applied to the tread surface 11 and suitable to exert an attraction force with respect to the antislip device 12. In this example, the magnet 26 is located between the furrows 22. Therefore, the attraction force is intended to operate on the plate 16 made of ferromagnetic material. According to alternative embodiments (see, for example, FIG. 7 described herein after), the return element may be made in the form of one or more elastic elements suitable to move the articulation structure and/or the support element back to the initial position. According to a first example, the articulation structure may be made in the form of one or more bending springs 18 which control the oscillation with respect to the axis X-X. More particularly, the pair of curved rods may be made as a pair of helical springs which are loaded by bending (see FIG. 6).

The use of the return effect due to the magnetic attraction exerted by the magnet 26 has the advantage of countering undesired raising of the support element 16 from the furrows 22 and in any case returning the element itself to the correct position as soon as the foot touches the ground. In the prior art, such undesired raising jeopardises the safety of the footwear when worn by a user, exposing him to the risk of tripping when walking.

The tread surface 11 preferably comprises an abutment portion including a track 28 located beneath the plate 16 and above the magnet 26, when the plate 16 is accommodated in the furrows 22. More specifically, the track 28 is located beneath the first projection 21*a* and it is parallel to the line identified by the first and second projection 21*a*, 21*b* (FIG. 2).

With particular reference to FIGS. 2 to 5 following is a description of the operation of the sole 10 according to the invention.

In FIG. 2 the sole 10 is shown in the inactivated state, wherein the plate 16 has the second side 16*b* facing outwards and it is accommodated in the furrows 22. The activated state, wherein the same plate 16 has the first antislip side 16*a* facing outwards and accommodated in the furrows 22, is instead represented in FIG. 5.

Figure 3:
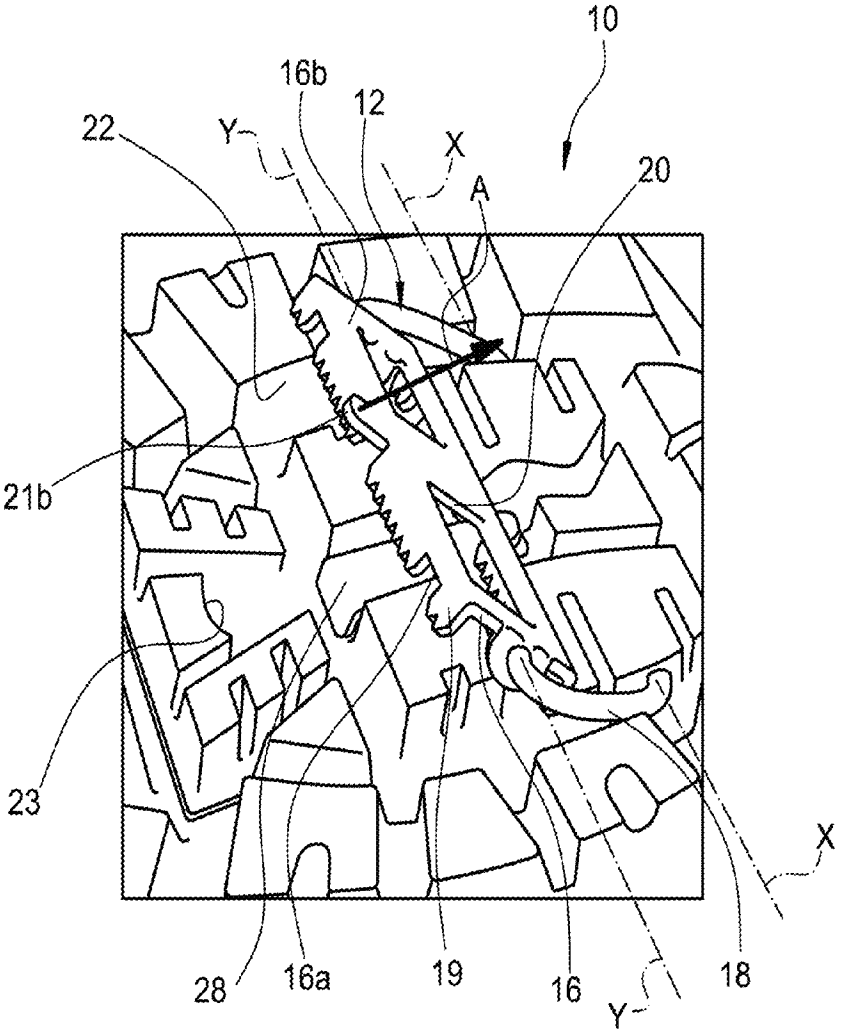
FIG. 3 is a view similar to FIG. 2 but showing the sole in a second operative state.

As visible in FIG. 3, when a user seizes the second projection 21*b* and pulls towards the direction of arrow A, the plate 16 starts rotating around its own revolution axis Y-Y. Therefore, the first projection 21*a* abuts against track 28 with which it is at contact and therefore causes the oscillation of the curved rods 18 around the oscillation axis X-X. In brief, in this step, the plate 16 simultaneously rotates around its own revolution axis Y-Y and with respect to the oscillation axis X-X, while the first projection 21*a* drags against the track 28 given that the magnet 26 tends to withhold it at contact therewith.

The optional presence of the recess 23 allows a user to grip the second projection 21*b* which—when the antislip device 12 is in the inactivated state—serves as a seizing portion more easily.

Advantageously, the cooperation between the first projection 21*a* (which serves as a countering portion) and the track 28 (which serves as an abutment portion) allows—with just one manoeuvre—a user to oscillate the curved rods 18 with respect to the oscillation axis X-X and turn the plate 16 around the revolution axis Y-Y.

Figure 4:
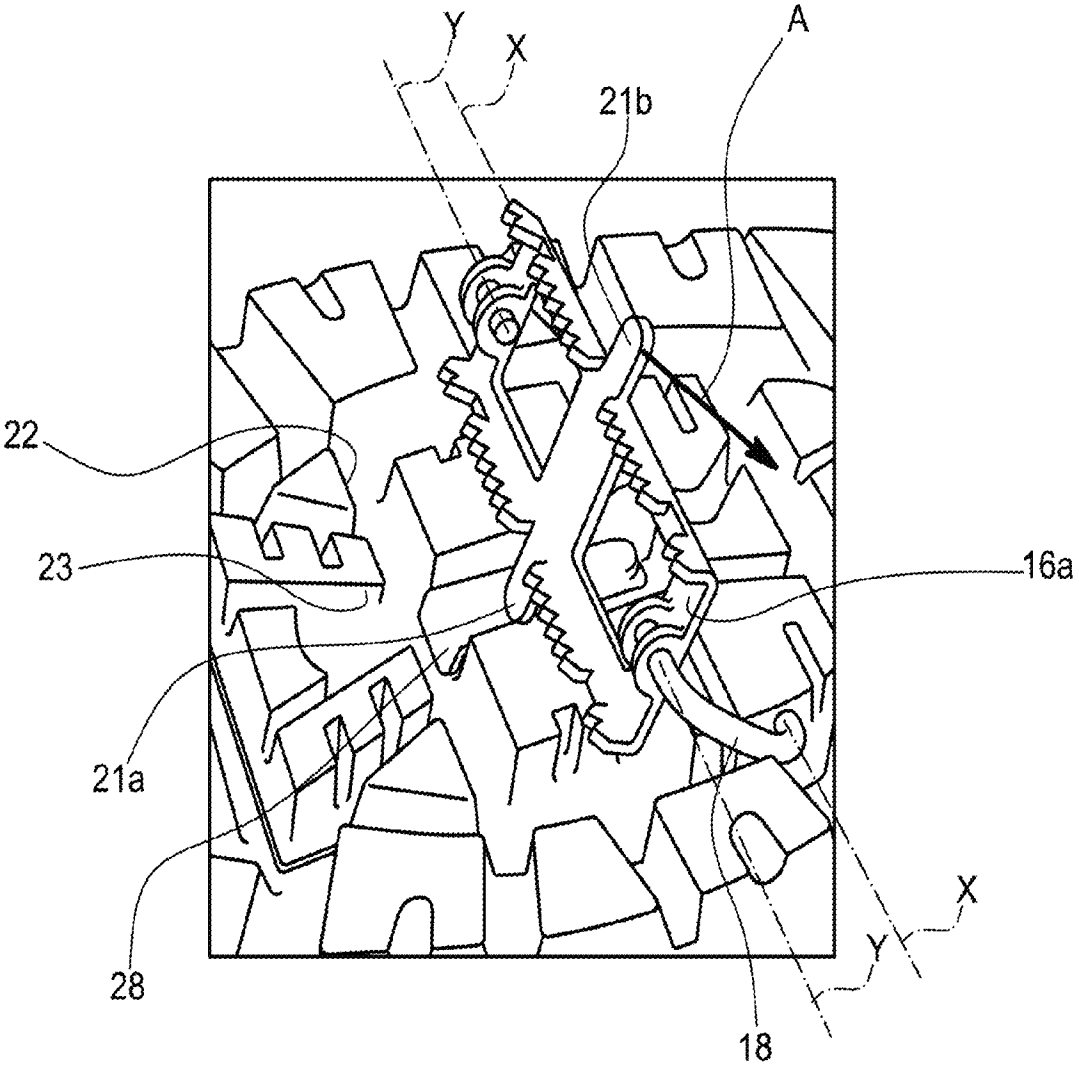
FIG. 4 is a view similar to FIGS. 2 and 3 but showing the sole in a third operative state.

Illustrated in FIG. 4 is a further step of the passage of the sole 10 from the inactivated state to the activated state. In this step, the projections 21*a*, 21*b* are in a position substantially perpendicular to the tread surface 11. A further rotation movement of the second projection 21*b* around the revolution axis Y-Y, in a manner assisted by the attractive force of the magnet 26, coincides with the complete rotation of the plate 16 in the activated state, wherein the first side 16*a* faces outwards (FIG. 5). Once the user terminates the simultaneous actuation of the plate 16 and rods 18, the magnet 26 withholds the plate 16 in the inactivated state inside the furrows 22. Thus, as a consequence, the use of the magnet 26 has the advantage of not requiring further manual coupling (snap-coupling or through other release coupling mechanisms) of the antislip device 12 with the tread surface 11 of the sole 10 by the user.

In order to return the plate 16 to the inactivated state, the user may seize the first projection 21*a* (which is now in the position in which the second projection 21*b* is illustrated in FIG. 2) and carry out the same operations described previously for the second projection 21*b*. In such case, the first projection 21*a* serves as a seizing portion.

Figure 7:
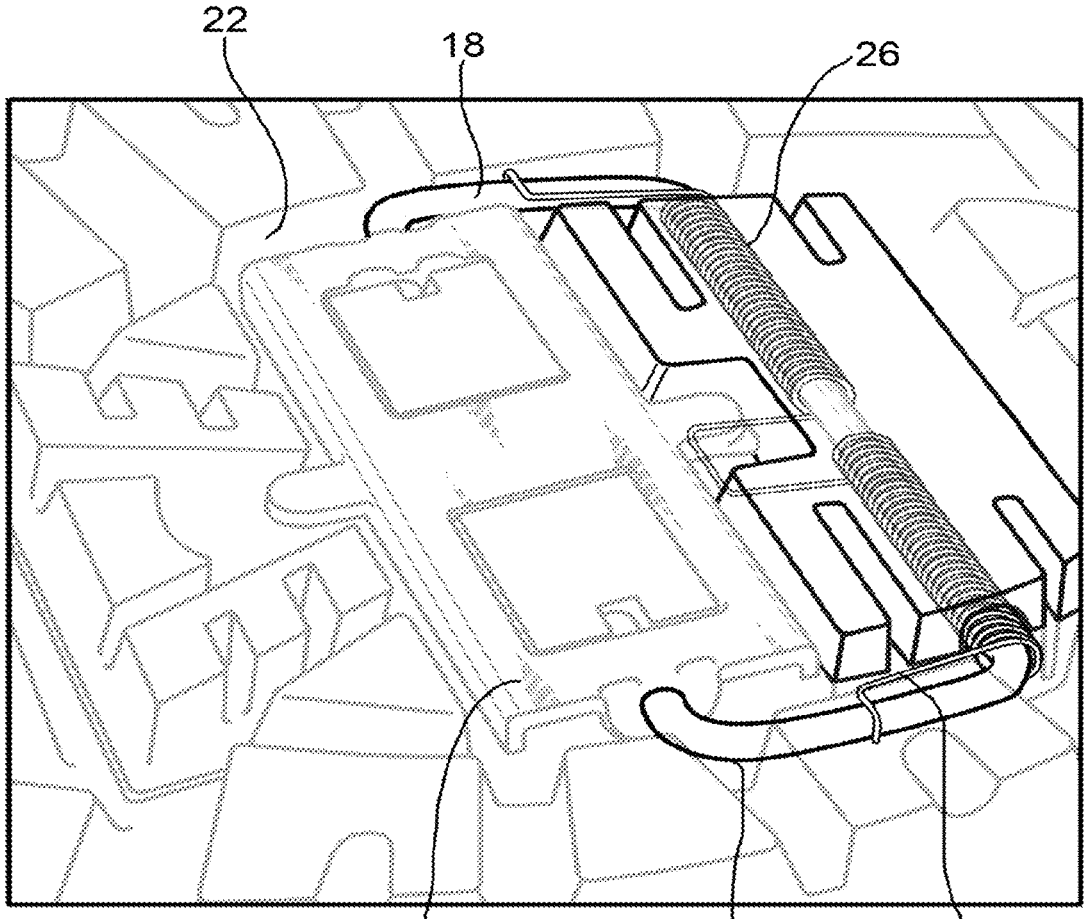
FIG. 7 is an enlarged perspective view of part of a sole in accordance with a further embodiment of the invention.

In the embodiment shown in FIG. 7, the return element countering oscillation of the antislip device comprises or consists of a spring 26. The spring 26, that in the example of FIG. 7 is a helical spring, is associated with the articulation structure 18 in order to exert thereupon a force permanently urging the plate 16 toward the sole or keeping it pressed against the sole. The spring 26 may be used as an alternative to or in combination with the above described magnet, according to requirements. In accordance with further variants (not shown) of the invention, the elastic return element may consist of a transversal portion which is incorporated in the tread, connects the two side rods 18 and acts as an axial torsion spring.

According to a further aspect of the present invention, the sole 10 for footwear may also have different technical characteristics outlined as follows.

The sole 10 for footwear is provided with at least one turnable antislip device 12, 14 provided for on the tread surface 11 of said sole 10 operatively facing towards the ground; said antislip device 12, 14 comprising:

- an articulation structure 18 mounted on the tread surface 11 and oscillatable moving away from said tread surface 11 with respect to an oscillation axis X-X;
- at least one support element 16 having an antislip side 16*a*, accommodatable in associated furrows 22 obtained in said tread surface 11 on the front portion of the sole 10, and rotatingly mounted with respect to the articulation structure 18 about a revolution axis Y-Y, selectively directing the antislip side 16*a* towards the ground or tread surface 11.

The distinguishing feature regarding this further aspect of the invention lies in the fact that, when said antislip device is located in the furrows 22, the oscillation axis X-X is interposed between the support element 16 and the tip 10*a* of said sole.

Due to such distinguishing features of the sole according to this further aspect of the present invention, the opening of the articulation structure 18, moving away, occurs in a direction matching the walking direction of a user wearing a shoe provided with such sole. Thus, in case of inadvertent opening of the device, it would tend to return towards the accommodation furrows 22 as soon as the user's foot comes into contact with the ground again. On the contrary, the soles according to the prior art operate with an opening moving away in a direction "opposite" to the walking direction of the user. Thus implies that, in case of inadvertent opening, the support element 16 of the soles of the prior art would abut against the ground, causing loss of balance and subsequent tripping of the user.

Without prejudice to the principle of the present invention, the embodiments and details may of course vary, even significantly, with respect to what has been described and illustrated strictly for exemplifying and non-limiting purposes without departing from the scope of the invention as defined in the attached claims.

What is claimed is:

1. A sole for footwear provided with at least one turnable antislip device on the tread surface of said sole operatively facing the sole, the antislip device comprising:

an articulation structure mounted on the tread surface and oscillatable moving away from the tread surface with respect to an oscillation axis;

at least one support element having an antislip side, accommodatable in an associated accommodation portion provided for on said tread surface, and rotatingly mounted with respect to the articulation structure around a revolution axis different from the oscillation axis, directing the antislip side selectively in an activated state towards the ground or in an inactivated state towards the tread surface;

return means tending to counter the oscillation of the antislip device with respect to the oscillation axis;

wherein the rotation of the support element around the revolution axis controls the rotation of the articulation structure with respect to the oscillation axis, and that the oscillation axis is interposed between the support element and the tip of the sole, when the support element is accommodated in the accommodation portion.

2. A sole according to claim 1, wherein the antislip device is at least partially made of ferromagnetic material and the return means comprise a magnet applied onto the tread surface and suitable to exert an attraction with respect to the antislip device.

3. A sole according to claim 2, wherein the support element is at least partially made of ferromagnetic material and the magnet tends to withhold the support element into the accommodation portion.

4. A sole according to claim 1, wherein the return means include at least one elastic means associated with the articulation structure for exerting thereon a force permanently urging the support element towards the sole or keeping the support element adjacent the sole.

5. A sole according to claim 1, wherein the support element has at least one countering portion transversely external with respect to the revolution axis and made to push and slide against an abutment portion on the tread surface, causing the oscillation of the articulation structure during the rotation of the support element around the revolution axis.

6. A sole according to claim 5, wherein said countering portion comprises a projection projecting transversely with respect to the revolution axis and the abutment portion includes a track which allows the sliding of said projection thereon during the rotation of the support element.

7. A sole according to claim 5, wherein the countering portion is made of ferromagnetic material and the return means comprise a magnet located beneath the abutment portion.

8. A sole according to claim 5, wherein the support element includes a second countering portion symmetric with respect to the first countering portion with respect to the revolution axis.

9. A sole according to claim 1, wherein the revolution axis is substantially parallel to the oscillation axis.

10. A sole according to claim 1, including at least one antislip device located in a front portion of the sole, in a metatarsal zone.

11. Footwear comprising a sole provided with at least one turnable antislip device on the tread surface of said sole operatively facing the sole, the antislip device comprising:

an articulation structure mounted on the tread surface and oscillatable moving away from the tread surface with respect to an oscillation axis;

at least one support element having an antislip side, accommodatable in an associated accommodation portion provided for on said tread surface, and rotatingly mounted with respect to the articulation structure around a revolution axis different from the oscillation axis, directing the antislip side selectively in an activated state towards the ground or in an inactivated state towards the tread surface;

return means tending to counter the oscillation of the antislip device with respect to the oscillation axis;

wherein the rotation of the support element around the revolution axis controls the rotation of the articulation structure with respect to the oscillation axis, and that the oscillation axis is interposed between the support element and the tip of the sole, when the support element is accommodated in the accommodation portion.

* * * * *